United States Patent [19]

Paton et al.

[11] 4,061,180

[45] Dec. 6, 1977

[54] INSTALLATION FOR ELECTROSLAG MELTING OF HEAVY-WEIGHT METAL INGOTS

[76] Inventors: Boris Evgenievich Paton, ulitsa Kotsjubinskogo, 9, kv. 21; Boris Izrailevich Medovar, bulvar Lesi Ukrainki, 2, kv. 8; Vitaly Mikhailovich Baglai, ulitsa Semashko, 10, kv. 54/3; Jury Vadimovich Latash, ulitsa Artema, 55, kv. 23; July Georgievich Emelyanenko, ulitsa Darvina, 5, kv. 5; Leonid Mikhailovich Stupak, Brest-Litovskoe shosse, 39, kv. 9; Jury Fedorovich Alferov, bulvar Lepse, 29, kv. 64; Oleg Petrovich Bondarenko, ulitsa Kreschatik, 15, kv. 34; Grigory Bentsionovich Schupak, ulitsa Chudnovskogo, 7, kv. 61; Lev Andreevich Shuruev, ulitsa Gagarina, 10/2, kv. 7, all of Kiev; Kim Moiseevich Khasin, ulitsa K. Marxa, 35, kv. 17, Novosibirsk; Jury Fedorovich Frolov, ulitsa K. Marxa, 8/2, kv. 70, Novosibirsk; Valery Vasilievich Salmin, ulitsa Zorge, 95, kv. 69, Novosibirsk; Vladimir Ivanovich Lugovsky, ulitsa Pamirskaya, 48, kv. 70, Novosibirsk; Vilen Fedorovich Marjuschenko, ulitsa Televizionnaya, 11, kv. 7, Novosibirsk; Fedor Fedorovich Shaburov, ulitsa Rimskogo-Korsakova, 4, kv. 64, Novosibirsk, all of U.S.S.R.; Jury Andreevich Schelkunov, deceased, late of Novosibirsk, U.S.S.R.; by Margarita Petrovna Schelkunova, administratrix, ulitsa Akademika Komarova, 19a, kv. 87, Moscow, U.S.S.R.

[21] Appl. No.: 699,172

[22] Filed: June 23, 1976

[51] Int. Cl.[2] ..... B22D 23/06

[52] U.S. Cl. ..... 164/252

[58] Field of Search ..... 164/52, 252

[56] References Cited

U.S. PATENT DOCUMENTS

| | | | |
|---|---|---|---|
| 3,713,476 | 1/1973 | Paton et al. | 164/52 |
| 3,724,530 | 4/1973 | Latash | 164/252 |
| 3,915,217 | 10/1975 | Ellebrecht et al. | 164/52 |

*Primary Examiner*—Ronald J. Shore
*Attorney, Agent, or Firm*—Holman & Stern

[57] ABSTRACT

An installation has a hollow cooled mould with a bottom plate having a cooled protrusion which partially enters the cavity of the cooled mould from underneath and forms the bottom of the mould at the beginning of melting. The protrusion is of a height exceeding that of the ingot forming walls of the cooled mould, and of a cross section allowing the cooled mould to be lowered to a level at which the ingot forming section of the cooled mould wall is below the upper end face of the cooled protrusion. The installation is compact in size and permits the use of a crane for upward removal of an ingot from the cooled mould.

3 Claims, 2 Drawing Figures

INSTALLATION FOR ELECTROSLAG MELTING OF HEAVY-WEIGHT METAL INGOTS

BACKGROUND OF THE INVENTION

The present invention relates to installations for electroslag melting of heavy-weight metal ingots.

Commonly known are installations for electroslag melting of metal ingots, having vertical columns which mount at least one electrode holder to fix therein one or several consumable electrodes and to feed electric current to them. Mounted on the columns below the electrode holder with possible vertical displacement is a cooled mould positioned on a cooled bottom plate forming a bottom of the mould.

The mould has a through cavity whose upper portion has a wider cross section than the lower portion.

The wider upper portion of the cavity of the cooled mould is intended to accommodate a slag bath and to melt consumable electrodes therein, while the lower more narrow portion of the cavity of the cooled mould is intended to collect molten metal for its crystallization into an ingot. The value of the cross section of the lower portion of the cavity is selected so as to be substantially close to the value of the cross section of the consumable electrode subject to melting or to the total value of the cross-sectional areas of several consumable electrodes subject to simultaneous melting-down.

In the course of electroslag melting of metal, the consumable electrodes and the bottom plate remain stationary, while the cooled mould is moved upward as the ingot is being built up.

In an installation described in U.S. Pat. No. 3,713,476, a hollow cooled mould is placed on a bottom plate having a protrusion which at the beginning of melting completely enters the cavity of the mould from underneath. The upper end face of the protrusion is positioned considerably below the ingot forming section of the cooled mould.

A space is left above the protrusion in the lower portion of the cooled mould cavity for forming the bottom portion of the metal ingot being produced. In the course of melting the ignot, first portions of melted metal solidify the end face of the protrusion.

With the height of a built-up metal ingot increasing, the cooled mould is raised correspondingly.

The rate of ingot growth and correspondingly the rate of raising the cooled mould are selected with respect to conditions ensuring the melting of a high-quality metal ingot. For this purpose the cooled mould is moved upward so that almost the entire upper portion of a crystallized ingot is located in the lower ingot-forming section of the cooled mould.

On completion of melting the consumable electrodes, the cooled mould is emptied of slag. Also removed are discarded ends of the consumable electrodes together with standard parts of electrodes, to which the ends of consumable electrodes are attached (welded). The cooled mould is moved upward until a produced metal ingot fully goes out from its lower portion, thereafter a carriage with the bottom plate together with an ingot placed thereon is rolled out of the melting installation.

Usually used with this known installation for melting metal ingots weighing from 150 to 200 t and heavier are relatively short consumable electrodes, with the length of each of them equal to the height of an ingot being produced. The consumable electrodes are secured in an electrode holder mounted on a relatively simple metal structure, for example, columns with guide members for vertical displacement of the cooled mould longitudinally in relation to the columns.

So, the known installation is able to solve the problem of producing heavy-weight metal ingots.

However, the known installation cannot do without relatively long standard parts to which consumable electrodes are welded. In melting ingots weighing up to 200 t, the length of the standard parts is as much as 4 to 5 m. This is dictated by the fact that on completion of the melting process the cooled mould should be raised until the head portion of an ingot goes out of the cooled mould cavity. And because the consumable electrodes are secured stationary on the standard parts the reserve upward stroke of the cooled mould along the columns can be ensured only as a result of increasing the length of the standard parts at least by the value of the height of the ingot forming wall portion of the mould. This height for ingots weighing 200 t is from 1.5 to 2.0 m.

The increased length of the standard parts of the electrode holder leads to growing resistance and inductive reactance of the furnace and this in turn results in a more powerful source of electric energy needed for feeding the installation.

Due to the use of long standard parts the known installation is of a relatively large height and this consequently requires more materials, usually steel, to be needed for its manufacture.

SUMMARY OF THE INVENTION

The principal object of the present invention is to provide an installation for electroslag melting of heavy-weight metal ingots which will permit application of shorter standard parts and consequently will be more compact than the known installation.

Another no less important object is to reduce the amount of metal needed for the manufacture of the installation.

One more object of the invention is to reduce resistance and inductive reactance of the installation and consequently to use a less powerful source of electric energy for operation of the installation.

Another object of the invention is to reduce the floor area needed for mounting the installation and to simplify the furnace design.

These and other objects are achieved by an installation for electroslag melting of heavy-weight metal ingots by melting consumable electrodes, comprising at least one electrode holder mounted on vertical columns for fixing therein one or several consumable electrodes and for feeding electric current to them, a cooled mould positioned below the electrode holder and mounted for possible vertical displacement along the columns and having a through cavity whose clear cross section in the slag bath zone is larger than the clear cross section in the ingot forming zone and the latter cross section is substantially close in value to the cross-sectional area of one or several consumable electrodes being simultaneously melted, and a bottom plate positioned below the cooled mould and having a vertical cooled protrusion entering the cavity of the cooled mould from underneath and forming a bottom thereof at the beginning of melting. The cooled protrusion on the cooled bottom plate partially enters the cavity of the cooled mould at the beginning of melting and has a height exceeding that of the ingot forming section of the cooled mould wall, and a cross section permitting lowering of the cooled mould to a level at which the ingot forming section of the cooled mould wall is below the upper end face of the cooled protrusion.

This provision of the bottom plate with the protrusion of the above dimensions allows the cooled mould to be lowered to a position at which the lower end face of the metal ingot goes beyond the limits of the ingot forming zone for easier extraction of the ingot from the cooled mould by means of a crane.

This in turn, makes it possible to use shorter (twice as short) standard parts for mounting the consumable electrodes and also to reduce the length of columns to provide conditions for the creation of a more compact electroslag installation as compared with known ones.

It is expedient that the height of the cooled protrusion on the cooled bottom plate is 1.05 to 1.2 of the height of the ingot forming section of the cooled mould wall.

This height of the cooled protrusion permits the object of the invention to be successfully achieved. This height is sufficient enough for a crane to grip the ingot and remove it from the bottom plate protrusion without inflicting any damage to the ingot forming section of the wall of the cooled mould lowered at this moment to the extreme lower position.

It is desirable that in the slag bath zone the cooled mould cavity is flared upward so that the upper section of the cooled mould wall, which defines the cavity is at an angle of 2° to 10° to the vertical.

The above limits of the angle of inclination of the upper section of the cooled mould wall permit unrestricted downward displacement of the mould at the end of melting and for releasing the ingot bottom portion from the forming portion of the mould when the mould is located on the upper end face of the protrusion positioned above the level of the ingot forming section of the cooled mould wall.

At angles of inclination of the upper section of the cooled mould wall less than 2°, the upper portion of the cooled mould may get blocked with solidified slag.

At angles more than 10° the overall dimensions of the upper portion of the cooled mould are considerably and unreasonably increased.

BRIEF DESCRIPTION OF THE DRAWINGS

Other objects and advantages of the present invention will be more clearly understood from the following detail description of an installation for electroslag melting of heavy-weight metal ingots with reference to the accompanying drawings, in which.

DETAILED DESCRIPTION OF THE PREFERRED EMBODIMENT

Figure 1:
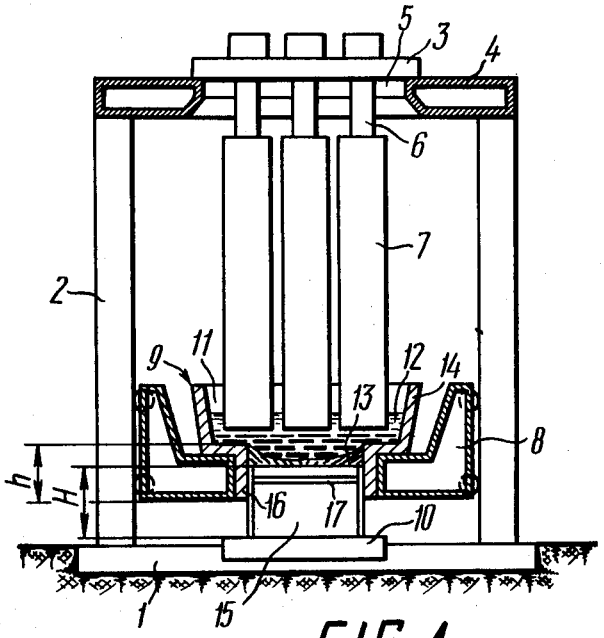
FIG. 1 is a vertical sectional view of an installation at the initial period of melting.

An installation for electroslag melting of heavy-weight metal ingots includes vertical columns 2 (FIGS. 1 and 2) mounted on a base 1. Secured on the columns is an electrode holder 3 (FIG. 1) held by upper cross members 4 with an opening 5. Fixed in the electrode holder 3 are standard parts 6 for feeding electric current to consumable electrodes 7.

Mounted on lower cross members 8 with possible vertical displacement along the columns 2 is a cooled mould 9 mounted on a cooled bottom plate 10.

The cooled mould 9 has a through cavity 11 within which is a slag bath zone 12 of a clear cross section exceeding that within the zone of forming a metal ingot 13.

The clear cross section in the zone of forming the metal ingot 13 is selected to be substantially close in value to the cross-sectional area of one or several consumable electrodes 7 being simultaneously melted. The cavity 11 in the slag bath zone 12 of the cooled mould 9 is flared upward so that an upper section 14 (FIG. 2) of the wall of the cooled mould 9, which defines the cavity, is at an angle $\alpha$ to the vertical, to be within 2° to 10°.

The upper working surface of the cooled bottom plate 10 has a vertical cooled protrusion 15 which enters the cavity 11 of the cooled mould 9 from underneath and forms the bottom of the mould at the beginning of melting. An asbestos sealing 17 is placed in a clearance between the cooled protrusion 15 and a lower section 16 of the wall of the cooled mould 9.

Figure 2:
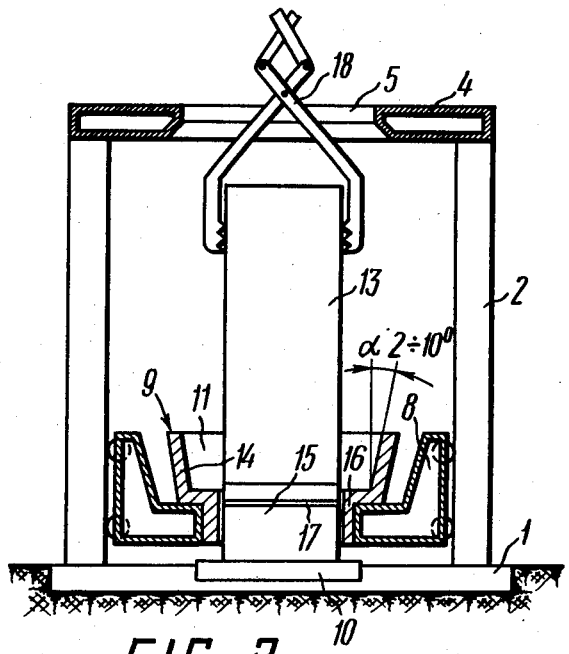
FIG. 2 is a view of the same installation as in FIG. 1 at the end of melting when the ingot is gripped for removal from the bottom plate protrusion.

The cooled protrusion 15 is of a height H which exceeds the height $h$ of the lower wall section 16 of the cooled mould 9, which forms the ingot 13, and of a cross section permitting the cooled mould 9 to be lowered to a level at which the wall section 16 of the cooled mould 9, which forms the ingot 13, is below the upper and face of the cooled protrusion 15. The preferable height (H) of the cooled protrusion 15 on the cooled bottom plate 10 is 1.05 to 1.2 of the height (h) of the lower wall section 16 of the cooled mould 9, which forms the ingot 13. Displacement of the cooled mould 9 is effected by means of a vertical displacement drive (not shown in the drawings). The installation can be provided with several electrode holders 3 (FIG. 1).

The metal ingot 13 produced by melting can be removed from the cooled mould 9 by a grip 18 (FIG. 2) of a shop crane (not shown in the drawings).

The installation for electroslag melting of heavy-weight metal ingots operates as follows:

At the beginning of melting, the cooled mould 9 (FIG. 1) is mounted on the cooled bottom plate 10 so that the cooled protrusion 15 partially enters the lower portion of the cavity 11 of the cooled mould 9. The upper end face of the cooled protrusion 15 is located below the lower wall section 16, which forms the ingot 13, through a distance sufficient for forming the bottom portion of the ingot 13. The asbestos sealing 17 is placed in the clearance between the cooled protrusion 15 and the lower wall section 16 of the cooled mould 9.

The cavity 11 of the cooled mould 9 is filled with melted slag to create the slag bath 12 wherein the consumable electrodes 7 are immersed. Then, from an electric power source (not shown in the drawings) current is fed to the consumable electrodes 7. Electric current flows between the consumable electrodes 7 through the slag bath 12 or between the consumable electrodes 7 and the protrusion 15 of the cooled bottom plate 10 (depending on the electric circuit diagram for connection to the electric power source). This liberates heat which heats the slag bath 12 to the melting temperature of the consumable electrodes 7. Liquid metal gets on the upper end face of the protrusion 15, whereon it cools and hardens into the metal ingot 13.

Upon forming the lower portion of the metal ingot 13 in the space below the lower wall section 16 of the cooled mould 9, the latter is moved upward by means of the drive (not shown in the drawings) kinematically linked with the lower cross members 8. The cooled mould 9 is lifted to such a value at which the level of liquid metal, as new portions thereof are being added, is found near the upper end face of the lower wall section 16 of the cooled mould 9.

After the consumable electrodes 7 are melted (when only discarded ends thereof are left at the standard parts 6), the power supply is switched off and the lifting of the cooled mould 9 is discontinued. Thereafter slag is drained from the upper section 14 of the cooled mould 9 and, the discarded ends of the consumable electrodes 7 and the standard parts 6 are removed from the electrode holder 3.

As the ingot 13 is cooled its cross section is reduced and this allows the cooled mould 9 to be lowered to its extreme lower position upon the cooled bottom plate 10, at which the cooled protrusion 15 fully enters the cavity 11 of the cooled mould 9 from underneath and occupies a position 100 - 200 mm higher than the upper end face of the wall lower section 16 of the cooled mould 9. To remove the metal ingot 13 from the cooled protrusion 15 the grip 18 of a crane is introduced through the opening 5 in the upper cross members 4 and the metal ingot 13 is carried away by the grip.

In the installation described herein, 2-meter long standard parts can be used instead of 4-meter long ones utilized in the known installations. This considerably reduces the total length of the current-bearing standard parts and consumable electrodes and, consequently significantly lessens resistance and inductance of the furnace.

This also results in reduced loss of voltage in the standard parts and reduced loss of heat liberated when current flows through the parts.

Also, a less powerful source of electric current can be used for operation of the installation.

We claim:

1. An installation for electroslag melting of heavy-weight metal ingots by melting consumable electrodes comprising: vertical columns; at least one electrode holder secured on the vertical columns and adapted to fix therein one or several consumable electrodes and to feed electric current to them; a cooled mould positioned below the electrode holder and mounted for possible vertical displacement along the vertical columns and having a through cavity whose clear cross section in a slag bath zone is larger than a clear cross section in an ingot forming zone and, the latter cross section is substantially close in value to the cross-section area of one or several of the consumable electrodes being simultaneously melted; a cooled bottom plate having a vertical cooled protrusion, the cooled protrusion partially entering the cavity of the cooled mould from underneath and forming the bottom of the cooled mould at the beginning of melting, and being of a height exceeding a height of the ingot forming walls of the cooled mould and of a cross section allowing the cooled mould to be lowered to such a level at which the ingot forming section of the wall of the cooled mould is below the upper end face of the cooled protrusion; and a drive for displacing the cooled mould in vertical direction.

2. The installation as set forth in claim 1, wherein the height of the protrusion on the bottom plate is 1.05 to 1.2 of the height of the ingot forming section of the wall of the mould.

3. The installation as set forth in claim 1, wherein the cavity of the cooled mould in the slag bath zone is flared upward so that the cavity-defining upper section of the wall of the cooled mould forms an angle of 2° to 10° to the vertical.

* * * * *